US011745052B2

(12) United States Patent
Ozeki

(10) Patent No.: US 11,745,052 B2
(45) Date of Patent: Sep. 5, 2023

(54) EXERCISE EQUIPMENT

(71) Applicant: Takashi Ozeki, Nisitamagun (JP)

(72) Inventor: Takashi Ozeki, Nisitamagun (JP)

( * ) Notice: Subject to any disclaimer, the term of this patent is extended or adjusted under 35 U.S.C. 154(b) by 266 days.

(21) Appl. No.: 17/336,521

(22) Filed: Jun. 2, 2021

(65) Prior Publication Data

US 2021/0283459 A1 Sep. 16, 2021

Related U.S. Application Data

(63) Continuation of application No. PCT/JP2019/038060, filed on Sep. 19, 2019.

(30) Foreign Application Priority Data

Dec. 3, 2018 (JP) ..... 2018-236773

(51) Int. Cl.
*A63B 21/00* (2006.01)

(52) U.S. Cl.
CPC ..... *A63B 21/4039* (2015.10); *A63B 21/151* (2013.01); *A63B 21/4034* (2015.10); *A63B 21/4035* (2015.10)

(58) Field of Classification Search
CPC ..... A63B 21/4039; A63B 21/151; A63B 21/4034; A63B 21/4035
See application file for complete search history.

(56) References Cited

U.S. PATENT DOCUMENTS 672,099 A * 4/1901 Jackson ..... A63B 22/0046 473/576
1,331,971 A * 2/1920 Adler ..... A63H 33/22 D21/466

(Continued)

FOREIGN PATENT DOCUMENTS

JP 63-118873 U 8/1988
JP 3105312 U 10/2004

(Continued)

OTHER PUBLICATIONS

Whakko's (https://www.etsy.com/listing/1281449199/whakkos-from-the-1970s-new-unassembled?show_sold_out_detail=1&ref=nla_listing_details) (manufactured and sold in the 1970s) (accessed Apr. 20, 2023) (Year: 1970).*

(Continued)

*Primary Examiner* — Andrew S Lo
(74) *Attorney, Agent, or Firm* — WHDA, LLP

(57) ABSTRACT

The present invention discloses an exercise equipment that enables a movement of the wrist and ankle while using portions between fingers of the hands and or foot, or using a pinching force of the adjacent fingers. The exercise equipment includes: a first string member made of a first non-stretchable string, the first string member having a first length; a first pressing member made of a hard material attached to one end of the first string member; a second pressing member made of the hard material attached to the other end of the first string member; a connecting member of being non-stretchable having a second length, the connecting member has a first end and a second end, the first end connected to an intermediate portion of the first string; and a fixing member provided at the other end of the connecting member.

5 Claims, 6 Drawing Sheets

(56) References Cited

U.S. PATENT DOCUMENTS 1,932,943 A * 10/1933 Smith ..... A63B 67/10 D21/465
2,125,815 A * 8/1938 Rowell ..... A63B 67/22 446/215
3,608,235 A * 9/1971 Harton ..... A63F 7/382 446/247
4,062,542 A * 12/1977 Manera ..... A63F 7/382 473/576
5,062,625 A * 11/1991 Vonk ..... A63B 21/4019 482/48
D326,484 S * 5/1992 Nwoke ..... A63B 23/03508 D21/466
5,136,911 A * 8/1992 Wyss ..... A61H 1/0288 84/467
D337,621 S * 7/1993 Wong ..... A63B 21/4019 D21/466
5,314,369 A * 5/1994 Gamble ..... A63B 67/10 473/576
5,492,335 A * 2/1996 Videnov ..... A63B 43/007 473/576
5,613,923 A * 3/1997 Anliker ..... A63B 23/03508 482/44
5,723,785 A * 3/1998 Manning ..... A63B 21/0552 73/379.03
D394,285 S * 5/1998 Mann ..... A63B 67/10 D21/466
6,776,742 B2 * 8/2004 Domenge ..... A63B 21/0608 482/148
9,289,645 B2 3/2016 Masterson et al.
9,707,472 B2 * 7/2017 Glass ..... A63F 7/40
9,943,738 B2 * 4/2018 Edge ..... A63F 7/382
10,617,966 B1 * 4/2020 Pena ..... A63H 5/00
2008/0113854 A1 * 5/2008 Ferri ..... A61F 5/019 482/148
2015/0157893 A1 6/2015 Canevari
2017/0056713 A1 * 3/2017 Abdourazak ..... A63B 23/14
2018/0093127 A1 * 4/2018 Hinduja ..... A63B 21/4025
2018/0178049 A1 * 6/2018 Marquez ..... A63B 21/4039
2019/0192897 A1 * 6/2019 Meyer ..... A63B 21/151
2021/0178219 A1 * 6/2021 Negron ..... A63B 22/0046

FOREIGN PATENT DOCUMENTS

JP 3197086 U 4/2015
JP 6400872 B1 10/2018

OTHER PUBLICATIONS

International Search Report dated Dec. 17, 2019, issued in counterpart International Application No. PCT/ JP2019/038060 (1 page).

* cited by examiner

EXERCISE EQUIPMENT

TECHNICAL FIELD

The present invention relates to an exercise equipment that enables a movement of the wrist and ankle while using portions between fingers of the hands and or foot, or using a pinching force of the adjacent fingers. This exercise equipment enables, for example, a fluid movement of the hip joint and a rowing movement of the scapula. With this exercise equipment, for example, whole body exercise can be carried out even in a lying posture so that the spine is not tense.

BACKGROUND OF THE INVENTION

As shown in FIG. 7, there is a conventional Pilates type exercise tool for enabling a whole body exercise. This tool can enable an exercise even in a lying position to imitate an indoor exercise of moving the hip joint by riding a bicycle, or a rowing exercise when pulling a rope. This can restore the limb movement, the hip fluidity, the spine movement, the scapula fluidity, and the neck movement. This exercise equipment has become available to people because it allows an exercise in a lying position for those who cannot sit or walk, or for some reason to move certain limbs or hips.

The conventional exercise equipment above is provided with a bed that can be moved back and forth due to a compression spring provided on the frame body of the exercise equipment body. One end of the rope is connected to this bed, and the other end of the rope is provided with a strap. An exerciser on the bed can hold the strap with the palm of his hand or hangs it on the sole of his foot, thereby exercising against the stress of the compression spring. See Patent References No. 1 and No, 2. As another example, there is a finger stimulation health equipment that can stimulate each finger of a limb to improve motor function and promote blood circulation. This instrument is made of elastic silicone resin and rubber material, etc., to provide elasticity and stretchability. See Patent Reference No. 3.

PRIOR ART REFERENCES

Patent Reference No. 1: U.S. Pat. No. 9,289,645

Patent Reference No. 2: U.S. Patent Application Publication No. 2015/0157893

Patent Reference No. 3: Japanese registered utility model No. 3197086

SUMMARY OF THE INVENTION

The Objectives to be Solved by the Invention

Each of the exercise tools disclosed in Patent References Nos. 1 and 2 enables the exerciser to restore and improve the movement of the limbs, the fluidity of the hip joint, the movement of the spine, the fluidity of the scapula, and the movement of the neck. However, because of using a strap that can be gripped with the palm of the hand or hung on the sole of the foot, it does not enable the exerciser to place his or her weight on the fingertips, or hold out or turn over himself or herself for the purpose of expecting an improvement in the function of the pinching force between the fingers and feet. That is, it was not possible to improve the movement of the wrist or ankle, the finger force of pinching, or the force of bending the fingers.

The health device disclosed in Patent Reference No. 3 can stimulate the portions between the fingers of the limbs, or exercise the fingers. However, since this instrument is made of an elastic and flexible material, only the portions between the fingers without straining the spine. Therefore, it was impossible to carry out a whole body movement to link the spine, including the fluid movement of the hip joint and the scapula movement.

The exercise equipment of the present invention was invented in view of the above circumstances, and an object of the present invention is to provide an exercise equipment that can use the movement of the wrist or ankle, the pinching force of each finger of the limb, the bending force and the warping force. By using the exercise equipment of the present invention, the movement of the hip joint and the movement of the scapula can be enhanced by performing the whole body exercise linked from the spine, and the skeleton can be restored to the correct posture.

Means to Solve the Problem

In order to solve the objectives as described above, the first aspect of the present application is an exercise equipment for an part between fingers of a hand or a foot, comprising: a first string member made of a first non-stretchable string, the first string member having a first length; a first pressing member made of a hard material attached to one end of the first string member; a second pressing member made of the hard material attached to the other end of the first string member; a connecting member of being non-stretchable having a second length, the connecting member has a first end and a second end, the first end connected to an intermediate portion of the first string; and a fixing member provided at the other end of the connecting member.

The second aspect of the present application is characterized in that the pressing member has a spherical surface which can provide a pressing surface to the part between the fingers.

The third aspect of the present application is characterized in that the pressing member has a flat surface which can provide a pressing surface to the part between the fingers.

The fourth aspect of the present application is characterized in that the pressing member is of a sphere or a is the hemisphere.

The fifth aspect of the present application is characterized in that the pressing member has a string insertion hole passing through a center of the pressing member, and that the first string is inserted through the string insertion hole, and a knot is formed at the end of the first string, thereby holding the pressing member at the end of the first string.

The sixth aspect of the present application is characterized in that the exercise equipment, further comprises: a second string member made of the first non-stretchable string, the second string member having a third length; a third pressing member made of the hard material attached to one end of the second string member; a fourth pressing member made of the hard material attached to the other of the second string member, wherein the first length is longer than the third length.

The seventh aspect of the present application is characterized in that the first pressing member and the second pressing member have the same size, and that the third pressing member and the fourth pressing member have the same size, and that the first pressing member and the third pressing member have a different size.

Effects of the Invention

According to the first aspect of the present invention, the exercise equipment of the present invention is provided with the pressing member made of a hard material, and the string and the connecting member are made of a non-stretchable material. The exerciser can use the pinching force, bending force, and warping force of the fingers and feet. By moving the wrists or ankles, it is possible to do a whole-body exercise linked from the spine even in a lying position. As a result, the movement of the scapula and the movement of the hip joint can be enhanced, and the skeleton can be restored to the correct posture. In addition, symptoms caused from skeletal distortion such as hallux valgus, floating fingers, O-legs, X-legs, and stiff shoulders can also be ameliorated. The whole skeleton can be restored to the correct state by whole body exercise, not just the legs and hands. Furthermore, the arch of the foot can be improved so as to stabilize the central axis, and therefore, injuries of the wrist and ankle can be prevented as well as functions thereof can be improved. The exercise equipment of the present invention can correct the skeleton and movement of one's body by exercising by himself or herself, unlike the exercise provided by a practitioner such as massaging.

According to the second and the fourth aspects of the present invention, the pressing surface of the pressing member is spherical. Therefore, the pressing member can effectively give stress to the parts between the fingers of the limbs, and the stress can be efficiently transmitted to the hip joint and the scapula, as well as the spine.

According to the third aspect of the present invention, the pressing surface of the pressing member to contact the part between the fingers is flat, thereby dispersing the stress, and therefore, the pain at the time of use can be alleviated.

According to the fifth aspect of the present invention, the end of the string is inserted into the string insertion hole of the pressing member, and the pressing member is held by the string at the knot formed on the string. As a result, the length of the string can be adjusted.

According to the sixth aspect of the present invention, the two string members have different length from each other. As a result, for example, four pressing members can be arranged horizontally with respect to the palm or sole of the user when using it. As a result, stress can be applied in the correct posture.

According to the seventh aspect of the present invention, a plurality of the pressing members have different sizes. As a result, it is possible to prevent interference between the pressing members in use and adjust the pinching force between fingers.

EMBODIMENTS TO CARRY OUT THE INVENTION

Figure 1:
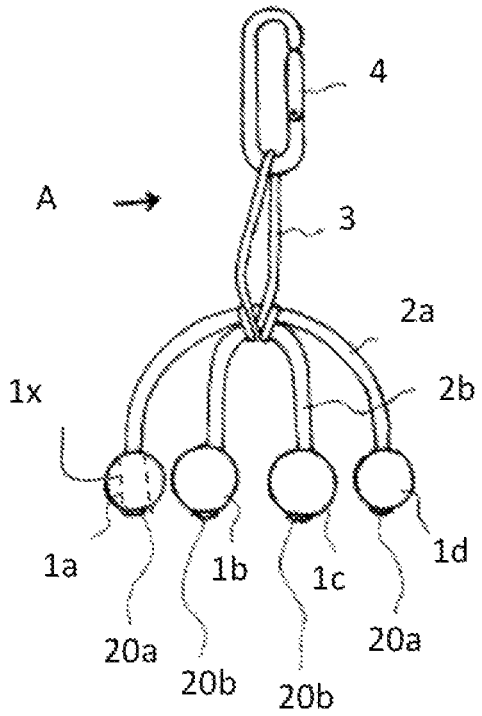
FIG. 1 is a schematic view of a first example of the exercise equipment of the present invention.

Hereinafter, the exercise equipment of the present invention is explained with references to the examples. FIG. 1 is an exercise equipment A according to a first example of the present invention. The exercise equipment A has two non-stretchable strings 2*a*, 2*b*, each having a predetermined length. To both ends of each of the two strings, four spheres 1*a*, 1*b*, 1*c* and 1*d* are attached as pressing members in a loosely fitted state. To an intermediate portion of the two strings 2*a*, 2*b*, one end of a non-stretchable connecting member 3 having a predetermined length is attached. The other end of the non-stretchable connecting member 3 is provided with a carabiner as a fixing member 4 in order to fix the exercise equipment A to an attached body such as an exercise tool body.

In this example, the strings 2*a* and 2*b* are held between all five fingers of a hand or foot of the user such that the spheres are positioned on the side of the palm or the sole. Four wooden spheres 1*a*, 1*b*, 1*c*, and 1*d* are provided at each end of the strings 2*a* and 2*b*. The pressing surface of the sphere against the part of the fingers is a spherical surface. The material of the spheres 1*a*, 1*b*, 1*c*, and 1*d* can be a hard material including wood, resin and metal in order to apply stress against the part between the fingers, transmitting the load to the hip joint and the scapula, and further transmitting the load to the spine for whole body exercise.

The two strings 2*a* and 2*b* and the connecting member 3 are non-stretchable and rigid, and are made of a material that can withstand a stress load during use by the user. The lengths of the strings 2*a* and 2*b* are set so that the spheres can be evenly positioned on the palm or sole of the user during the use. In this example, in a state where the spheres are held by the strings, the length of the string 2*a* located at the outside is longer than the length of the string 2*b* located at the inside. There is a difference of 2 cm in this example. As a result, when the exercise equipment A is used, the spheres 1*a*, 1*b*, 1*c*, and 1*d* can be horizontally and uniformly positioned on the palm or the sole of the user, and therefore, an even load can be applied between the four fingers.

Each of the four spheres 1*a*, 1*b*, 1*c*, and 1*d* is provided with a string through hole formed in the center thereof. The through hole 1*x* is shown by a dotted line on the sphere 1*a* of FIG. 1. After the ends of the strings 2*a* and 2*b* are passed through the string through holes, a knot is formed at each of the ends of the strings 2*a* and 2*b* to prevent the strings from coming off. As a result, the spheres 1*a*, 1*b*, 1*c*, and 1*d* are held in a loosely fitted state such that they can rotate and move with respect to the strings 2*a* and 2*b*. Therefore, depending on the user of the exercise equipment A, the lengths of the strings 2*a* and 2*b* can be adjusted by changing the locations of the knots appropriately for the user. In order to hold the spheres 1*a*, 1*b*, 1*c* and 1*d* at ends of each of the strings 2*a* and 2*b* having a predetermined length, the other means (e.g., a fixing means such as a clip or clamp) than the knot can be used.

In addition, in this example, the user holds it between all the fingers of the hand or foot at the same time. The four spheres can have the same size, but preferably, in order to avoid interference between the spheres 1*a*, 1*b*, 1*c*, and 1*d* in use as well as in order to draw out the pinching force between the fingers, the spheres 1*a*, 1*b*, 1*c*, 1*d* can be preferably different in size. Usually, the pinching forces of the index finger, the middle finger, and the ring finger are weaker than those of the thumb and little finger. In this example, the two spheres 1*a* and 1*d* located between the thumb and index finger and between the ring finger and little finger and held by the string 2*a* have the same size. Further, the two spheres 1*b* and 1*c* located between the index finger and the middle finger and between the middle finger and the ring finger and held by the string 2*b* have the same size. The diameters of the spheres 1*a* and 1*d* are different from the diameters of the spheres 1*c* and 1*d*. The diameters of the spheres 1*a* and 1*d* are 24 mm, and the diameters of the spheres 1*c* and 1*d* are 30 mm. As a result, it becomes possible to prevent interference between spheres during use and to adjust the pinching force between fingers. In particular, this arrangement positions a larger sphere at a location where the pinching force is weaker.

The diameters of the spheres 1*a*, 1*b*, 1*c*, and 1*d* and the lengths of the strings 2*a*, 2*b* can be appropriately adjusted depending on gender, age, and the like, as the sizes of the limbs and fingers are different.

In this example, the connecting member 3 is a loop-shaped non-stretchable string having a predetermined length. One end of this string is connected to an intermediate portion of the two strings 2*a* and 2*b*, and a fixing member 4 for fixing to an attached body such as an exercise tool main body is arranged on the other end side. A carabiner is used as the fixing member 4. The connecting member 3 can be a single string instead of the loop-shaped string as shown in FIG. 1. Further, the fixing member 4 is not limited to a carabiner, but a hook or the like can be used.

The strings 2*a* and 2*b* can be slidably connected to the connecting member 3 to the left side and the right side. When all of the four spheres held at both ends of the strings 2*a* and 2*b* are used at the same time, the strings 2*a* and 2*b* are held by the connecting member 3 at the center of the strings. On the other hand, when only a part of of the four spheres is used, the strings 2*a* and 2*b* are slided toward the direction of the spheres to be used with respect to the connecting member 3, so that the unused spheres can be held at the connecting member 3.

Figure 7:
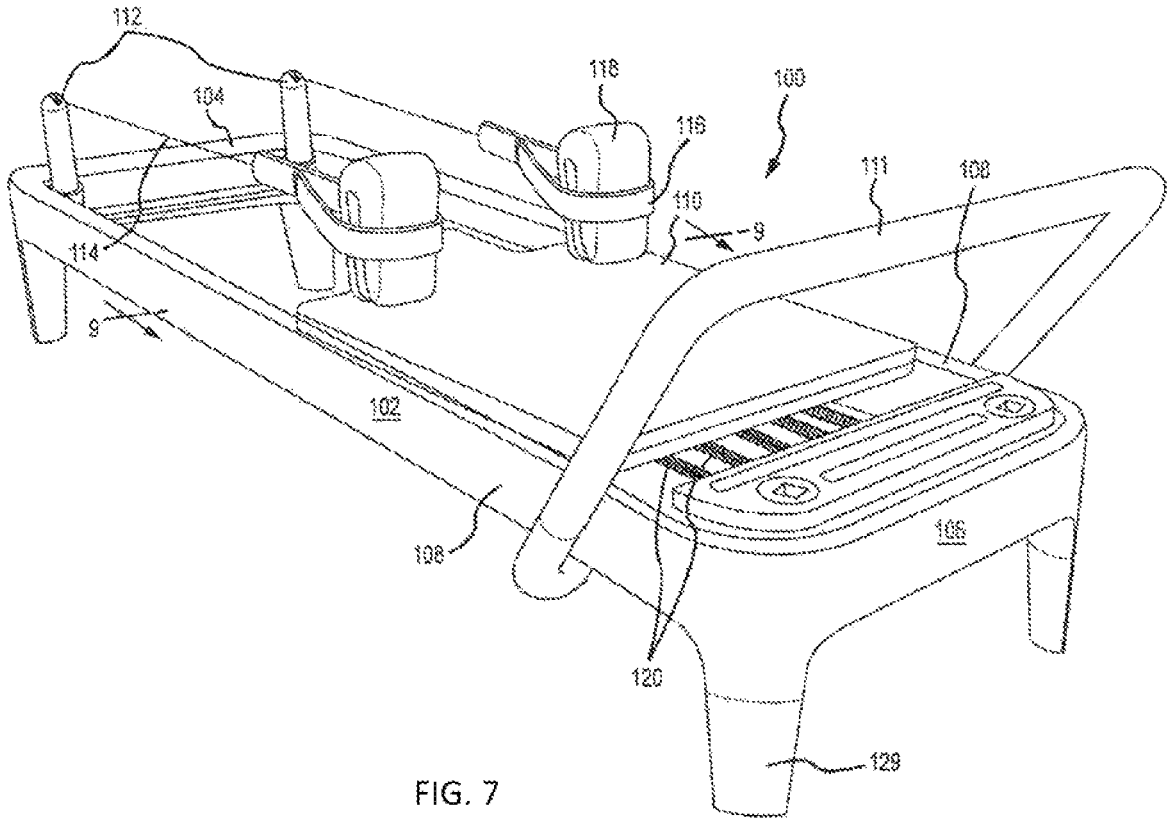
FIG. 7 is a schematic view of the main body of the exercise tool disclosed in Patent Reference No. 1.

With reference to FIG. 7, it is described about a method for using the exercise equipment A of the first example when it is attached to an attached body as a Pilates type exercise equipment main body. As shown in FIG. 7, the exercise equipment main body 100 is connected to a frame body, a bed 110 fixed to the frame body by a compression spring 120 and being slidable back and forth, two ropes 114 connected to the bed, and two straps 116 connected to the ropes. For example, two sets of the exercise equipments A of the first example are replaced with the straps 116, 116 by connected the carabiner 4 to a fixed means (not shown) provided at the end of the rope 114. The user (not shown) can exercise on the bed such that the spheres 1*a*, 1*b*, 1*c* and 1*d* are located on the palm or the sole by holding the strings 2*a* and 2*b* between the fingers of the hand or foot. While the strings 2*a*, 2*b* are held between the fingers, the user can exercise by resisting the stress of the compression spring 120.

Figure 2:
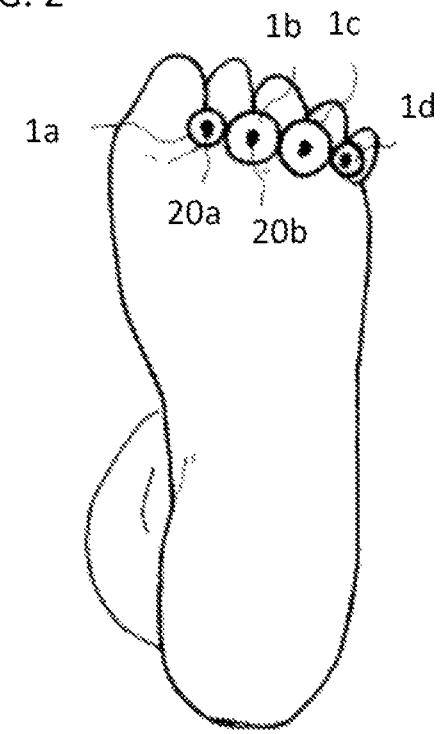
FIG. 2 is a schematic view illustrating a state in which the exercise equipment of the first example is used for the foot.

FIG. 2 is a view seeing the sole of one foot in which the exercise equipment A of the first example is used on both feet of the user. That is, the strings 2*a* and 2*b* are sandwiched between all four fingers of the user's foot, and the spheres 1*a*, 1*b*, 1*c* and 1*d* are positioned on the soles of the feet. As described above, the exercise equipment A is connected to the rope connected to the bed of the exercise equipment body. Therefore, while maintaining the state of holding the spheres 1*a*, 1*b*, 1*c* and 1*d* on the soles of the feet. the user can increase the movement of the hip joint by moving his or her foot into a direction including up, down, right, left, front, back and rotation to resist against the stress of the compression spring. Also, if the exercise equipment A is applied to the hand, the user can similarly increase the movement of the scapula by moving the spine around the center, and can restore the skeleton to the correct posture as a whole.

Figure 3:
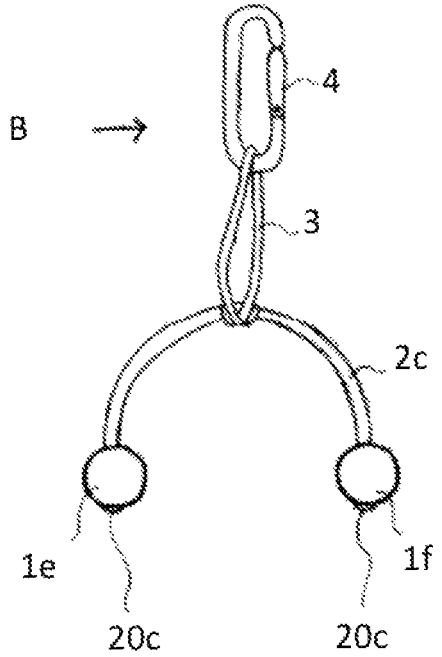
FIG. 3 is a schematic view of a second example of the exercise equipment of the present invention.
Figure 4:
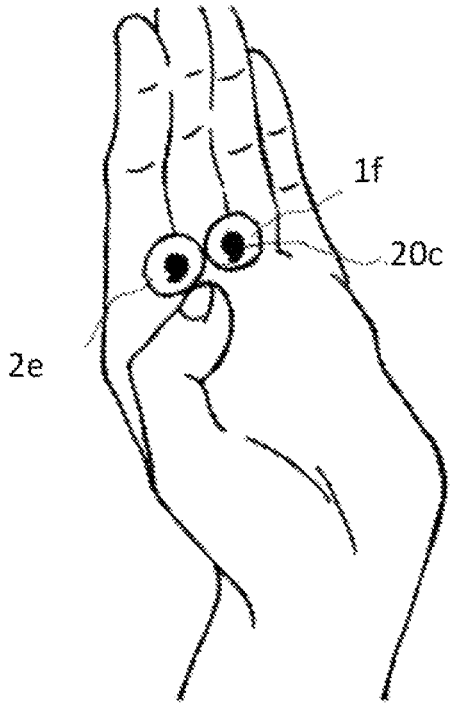
FIG. 4 is a schematic view illustrating a state in which the exercise equipment of the second example is used for the hand.

FIG. 3 is an exercise equipment B according to a second example of the present invention. The exercise equipment B of this example is different from the first example in that this example is composed of one string 2C and two spheres 1*e* and 1*f* arranged at both ends thereof. However, the connecting member 3, the fixing member 4, and the configuration to fix the exercise equipment B to an exercise tool main body are the same as those of the first example. In the second example, the sizes and diameters of the two spheres 1*e* and 1*f* are the same, and the method of attaching to the string 2C is the same as in the first example. FIG. 4 shows a state of use in which the exercise equipment B is positioned between the fingers of the user's hand. Here, the string 2C is held between the index finger and the middle finger and between the middle finger and the ring finger, so as to position the two spheres 1*e* and 1*f* on the palm of the user. In a state where the string 2C is held between these fingers, the user moves his hand up and down, left and right, back and forth, and in the direction of rotation. In particular, according to this exercise equipment B, it is possible to improve the pinching force of the three fingers, which tends to reduce muscle strength. Further, the thumb and little finger cannot be used, the load applied to the three fingers can be increased, and therefore, the difficulty of exercise is increased, and the exercise is more effective. However, it should be noted that fingers to hold the string is not limited to. The user can hold the string 2C between the finger that the user wishes to improve, strengthen or exercise.

Figure 5:
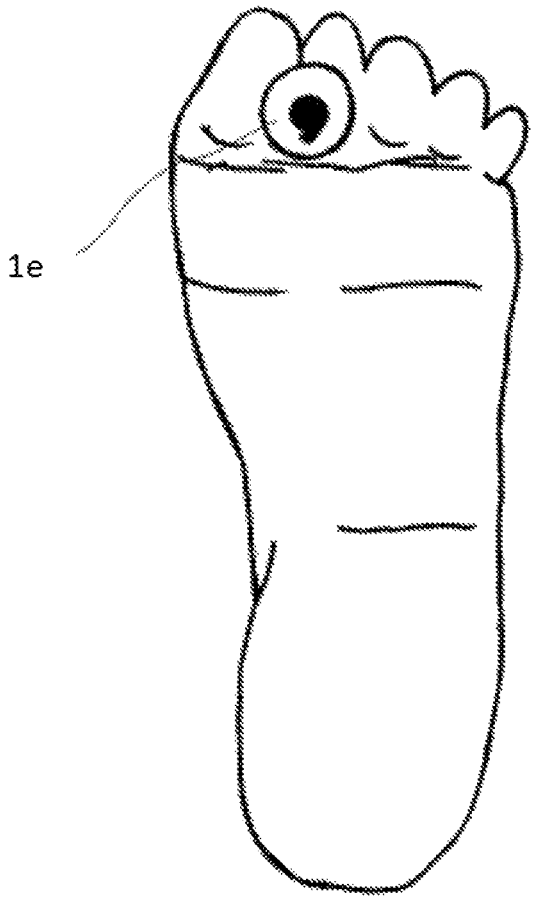
FIG. 5 is a schematic view illustrating a modified example of the second example with respect to its use method.

FIG. 5 is a modification of the method of using the exercise equipment of the second example, in which one of the two spheres 1*e* and 1*f* is used such that it is sandwiched between the thumb and index finger of the sole of the foot. In this way, one sphere 1*e*, 1*f* is held between arbitrary fingers whose pinching force is reduced. As a result, the load applied to the fingers can be increased, thereby improving the pinching force. It is noted that the exercise equipment of the first example, which has four spheres, can be used by employing only one of the spheres for the same reason.

In the first example and the second example as described above, spheres are exemplified as the pressing member. However, the pressing member can be not only of a sphere, but of a hemisphere, an ellipsoid, or the like, so long as the pressing surface which comes into contact with the fingers of the hand or foot is a spherical surface.

Figure 6:
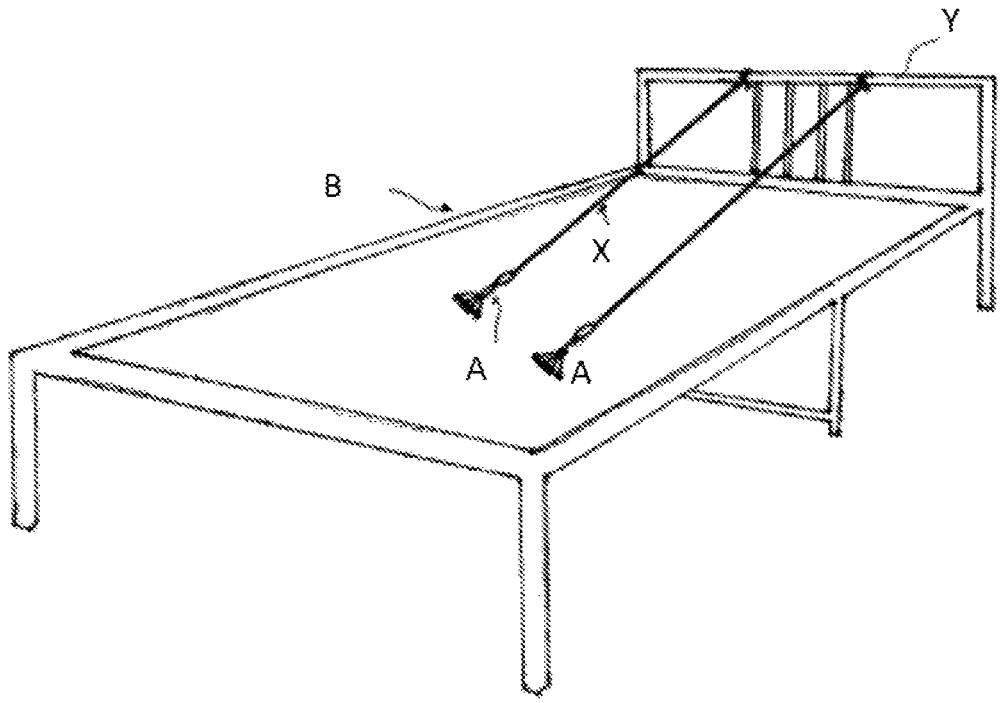
FIG. 6 is a schematic view illustrating a state in which the exercise equipment of the present invention equipped on a bed.

FIG. 6 shows an example in which the exercise equipment A is attached to a bed as the main body of the attached body. The exercise equipment A is connected to one end of a stretchable rubber tube X, and the other end of the rubber tube X is connected to the pipe Y or the like of the frame body of the bed B. As a result, the user can exercise with the exercise equipment A while lying on the bed or sitting on the bed by using the elastic force of the rubber tube.

Figure 8:
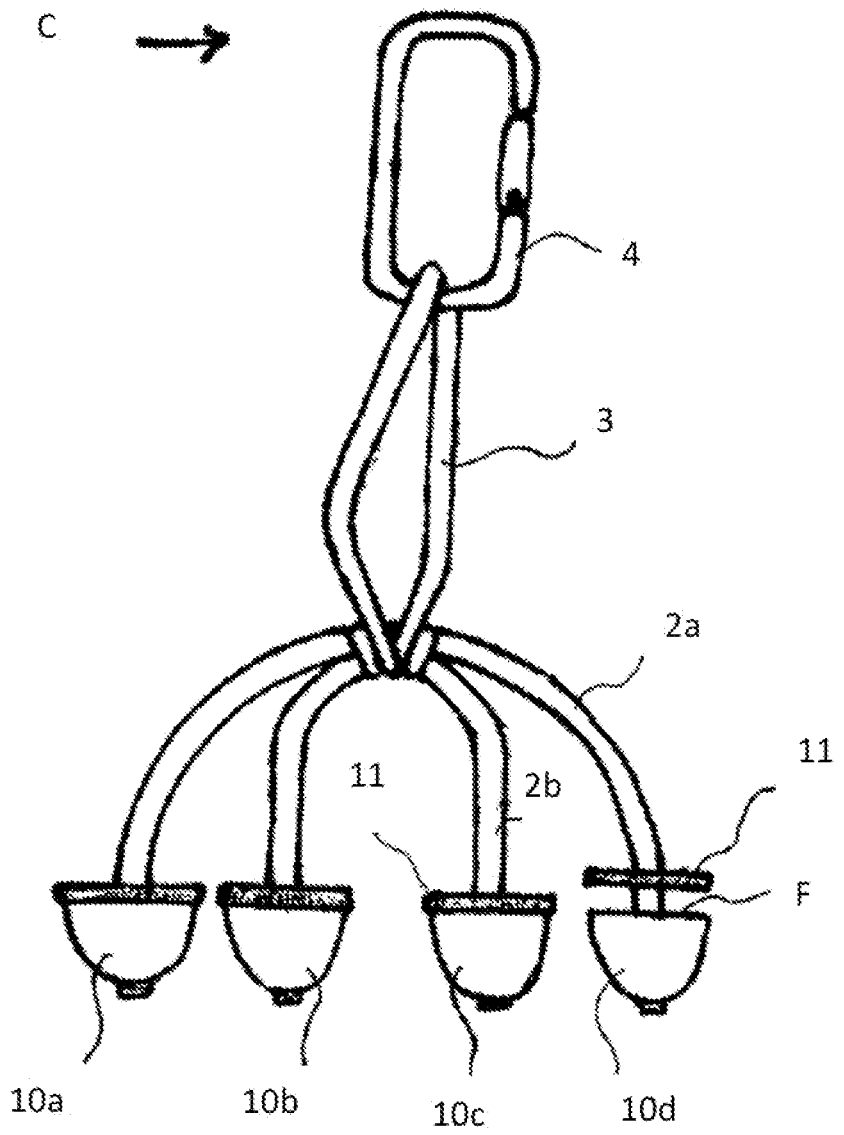
FIG. 8 is a schematic view of a third example of the exercise equipment of the present invention.

FIG. 8 shows an exercise equipment C of the third example of the present invention, in which hemispheres 10*a*, 10*b*, 10*c*, and 10*d* are used as the pressing member. When a sphere is used as the pressing member, stress is concentrated between the fingers of the user and effective exercise is possible, but it may sometimes give pain to the user, in particular, a beginner or an elderly person. In order to alleviate the pain, the stress can be dispersed to alleviate the pain by making the surface of the pressing member a substantially flat surface F which the fingers of the palm or the sole contact. Furthermore, the pain can be further reduced by interposing a disc-shaped rubber cushioning member 11 on the flat surface F of the pressing member. In addition, the cushioning member 11 can be used in the first example or the second example of the present application.

While the third example of the present application employs a hemisphere as the pressing member, it can be replaced with a truncated cone, a cylinder, or the like, so long as a substantially flat surface F is provided as the pressing surface which comes into contact with the fingers of the hand or foot.

The exercise equipment of the present invention can be used while the user is lying down, sitting down, or standing up. In the above description, the attached body was described as a Pilates-type exercise equipment body or a bed in which the user can use it while lying down or sitting. However, the attached body is not limited to the examples described before. For example, a member having a stretchable function can be used such that a compression spring is fixed to the main body of the exercise tool and the exercise equipment of the present invention is connected to the compression spring, in order for the user to use it in a standing posture.

In the present application, the first string member and the second string member can be of single string, a bundle of strings, a plurality of strings, or a loop of the string(s).

EXPLANATION OF THE REFERENCES IN THE DRAWINGS

A, B, C: exercise equipment;
1*a*, 1*b*, 1*c*, 1D, 1*e*, 1*f*: sphere;
10*a*, 10*b*, 10*c*, 10*d*: hemisphere;
2*a*, 2*b*: string;
20*a*, 20*b*, 20*c*: knot;
3: connecting member;
4: fixing member; and
11: cushion member.

What is claimed is:

1. An exercise equipment for a part between fingers of a hand or a foot, comprising:

a first string member made of a first non-stretchable string, the first string member having a first length;

a first pressing member made of a hard material attached to one end of the first string member;

a second pressing member made of the hard material attached other another end of the first string member;

a second string member made of the first non-stretchable string, the second string member having a third length, the first length being longer than the third length;

a third pressing member made of the hard material attached to one end of the second string member;

a fourth pressing member made of the hard material attached to another end of the second string member, wherein the first pressing member and the second pressing member have the same size, wherein the third pressing member and the fourth pressing member have the same size, wherein the first pressing member has a smaller size than the third pressing member, a connecting member that is non-stretchable having a second length, the connecting member has a first end and a second end, the first end tied to an intermediate portion of the first string member and the second string member; and a fixing member provided at the second end of the connecting member, wherein simultaneously, the first pressing member is configured to be held between a first toe and a second toe, while the third pressing member is configured to be held between the second toe and a third toe, while the fourth pressing member is configured to be held between the third toe and a fourth toe, and while the second pressing member is configured to be held between the fourth toe and a fifth toe, when the fixing member is pulled away from the first toe, the second toe, the third toe, the fourth toe and the fifth toe.

2. The exercise equipment according to claim 1, wherein each of the first pressing member and the second pressing member has a spherical surface.

3. The exercise equipment according to claim 1, wherein each of the first pressing member and the second pressing member has a flat surface.

4. The exercise equipment according to claim 1, wherein each of the first pressing member and the second pressing member is of a sphere or a hemisphere.

5. The exercise equipment according to claim 1, wherein each of the first pressing member and the second pressing member has a string insertion hole passing through a center of the respective pressing member, wherein the first string is inserted through the string insertion hole, and a knot is formed at the end of the first string, thereby holding the respective pressing member at the end of the first string.

* * * * *